United States Patent [19]

Croat

[11] Patent Number: 4,496,395

[45] Date of Patent: Jan. 29, 1985

[54] HIGH COERCIVITY RARE EARTH-IRON MAGNETS

[75] Inventor: John J. Croat, Sterling Heights, Mich.

[73] Assignee: General Motors Corporation, Detroit, Mich.

[21] Appl. No.: 274,070

[22] Filed: Jun. 16, 1981

[51] Int. Cl.[3] ..... C22C 33/00

[52] U.S. Cl. ..... 75/123 E; 148/31.57; 164/462; 420/416

[58] Field of Search ..... 75/170, 152, 123 E, 75/134 F; 148/31.57; 164/462, 463, 479, 423, 427, 429; 420/416

[56] References Cited

U.S. PATENT DOCUMENTS

| | | | |
|---|---|---|---|
| 3,102,002 | 8/1963 | Wallace et al. | 75/152 |
| 3,421,889 | 1/1969 | Ostertag et al. | 75/170 |
| 3,560,200 | 2/1971 | Nesbitt et al. | 75/170 |
| 3,615,911 | 10/1971 | Nesbitt et al. | 148/31.57 |
| 3,790,414 | 2/1974 | Tawara et al. | 75/170 |
| 3,845,805 | 11/1974 | Kavesh | 164/81 |
| 4,142,571 | 3/1979 | Narasimhan | 164/88 |
| 4,152,486 | 5/1979 | Imamura et al. | 75/123 E |
| 4,190,095 | 2/1980 | Bedell | 164/463 |
| 4,192,696 | 3/1980 | Menth et al. | 75/170 |
| 4,197,146 | 4/1980 | Frischman | 148/31.55 |
| 4,308,474 | 12/1981 | Savage et al. | 75/123 E |

FOREIGN PATENT DOCUMENTS 104862 3/1981 Japan .

OTHER PUBLICATIONS

Clark, "High-Field Magnetization and Coercivity of Amorphous Rare Earth-$Fe_2$ Alloys" Appl. Phys. Lett. vol. 23, No. 11, Dec. 1973, pp. 642–644.

Chaudhari et al., "Metallic Glasses" Scientific American Apr. 1980, pp. 98–117.

*Primary Examiner*—John P. Sheehan

*Attorney, Agent, or Firm*—E. F. Harasek

[57] ABSTRACT

Ferromagnetic compositions having intrinsic magnetic coercivities at room temperature of at least 1,000 Oersteds are formed by the controlled quench of molten rare earth-transition metal alloys. Hard magnets may be inexpensively formed from the lower atomic weight lanthanide elements and iron.

21 Claims, 6 Drawing Figures

HIGH COERCIVITY RARE EARTH-IRON MAGNETS

This invention relates to substantially amorphous rare earth-iron (Re-Fe) alloys with high room temperature magnetic coercivities and to a reliable method of forming such magnetic alloys from molten precursors.

BACKGROUND

Intermetallic compounds of certain rare earth and transition metals (RE-TM) can be made into magnetically aligned permanent magnets with coercivities of several thousand Oersteds. The compounds are ground into sub-crystal sized particles commensurate with single magnetic domain size, and are then aligned in a magnetic field. The particle alignment and consequently the magnetic alignment, is fixed by sintering or by dispersing the particles in a resinous binder or low melting metal such as lead. This is often referred to as the powder metallurgy process of making rare earth-transition metal magnets. When treated in this manner, these intermetallic compounds develop high intrinsic magnetic coercivities at room temperature.

The most common intermetallic compounds processable into magnets by the powder metallurgy method contain substantial amounts of the elements samarium and cobalt, e.g., $SmCo_5$, $Sm_2Co_{17}$. Both of these metals are relatively expensive due to scarcity in the world market. They are, therefore, undesirable components for mass produced magnets. Lower atomic weight rare earth elements such as cerium, praseodymium and neodymium are more abundant and less expensive than samarium. Similarly, iron is preferred over cobalt. However, it is well known that the light rare earth elements and iron do not form intermetallic phases when homogeneously melted together and allowed to crystallize as they cool. Moreover, attempts to magnetically harden such rare earth-iron alloys by powder metallurgy processing have not been successful.

This invention relates to a novel, efficient and inexpensive method which can be used to produce magnetically coercive rare earth-iron alloys directly from homogenous molten mixtures of the elements.

OBJECTS

It is an object of the invention to provide magnetically hard RE-TM alloys, particularly Re-Fe alloys, and a reliable means of forming them directly from molten mixtures of the elements. A more particular object is to provide a method of making magnetically hard alloys from mixtures of rare earth elements and iron which do not otherwise form high coercivity intermetallic phases when allowed to crystallize as they cool. A further object of the invention is to control the solidification of molten rare earth-iron mixtures to produce ferromagnetic alloys with substantially amorphous microstructures as determined by X-ray diffraction. A more specific object is to provide hard magnetic alloys with room temperature coercivities of at least several thousand Oersteds directly from molten mixtures of low atomic weight rare earth elements such as Ce, Pr, Nd and, the abundant transition metal, Fe, by a specially adapted quenching process.

BRIEF SUMMARY

In accordance with a preferred practice of the invention, a magnetically hard rare earth-iron metal alloy may be formed as follows. Mixtures of rare earth elements and iron are homogeneously alloyed in suitable proportions, preferably about 0.2 to 0.66 atomic percent iron and the balance rare earth metal. The preferred rare earth metals are the relatively low atomic weight elements which occur early in the lanthanide series such as cerium, praseodymium, and neodymium. These alloys have some room temperature coercivity, but it is generally less than 200 Oersteds. Herein, compositions with intrinsic coercivities less than about 200 Oersteds at room temperature (about 25° C.) will be referred to as soft magnets or as alloys having soft magnetic properties. The alloyed, magnetically soft Re-Fe mixture is placed in a cylindrical quartz crucible surrounded by an induction heating coil. The rare earth iron mixture is melted in the crucible by activating the induction heating coil. The crucible has an orifice at the bottom for expressing a minute stream of molten alloy. The top of the crucible is sealed and provided with means for introducing a pressurized gas above the molten alloy to propel it through the orifice. Directly adjacent the orifice outlet is a rotating chill disk made of highly heat conductive copper electroplated with chromium. Metal ejected through the orifice impinges on the perimeter of the rotating disk so that it cools almost instantaneously and evenly. The orifice diameter is generally in the range of 250–1200 microns. The preferred velocity of the perimeter of the rotating disk is about 2.5 to 25 meters per second. The disk itself, can be considered an infinitely thick chill plate. The cooling of the ejected molten alloy is, therefore, a function of heat transfer within the alloy itself onto the chill surface. I found that if the disk is maintained at room temperature, and the molten alloy is ejected through the orifice under a pressure of about 2.5 pounds per square inch, then the maximum thickness for cooled ribbon formed on the perimeter of the chill disk should be no more than about 200 microns. This provides a rate of cooling which produces the high coercivity magnetic alloys of this invention. Quench rate in spin melting can be controlled by adjusting such parameters as the diameter of the ejection orifice, the ejection pressure, the speed of the quench disk, the temperature of the disk and the temperature of the molten alloy. Herein the terms melt spinning and spin melting are used interchangeably and refer to the process of expressing a molten metal alloy through a small orifice and rapidly quenching it on a spinning chill surface.

Critical to the invention is controlling the quench rate of the molten Re-Fe alloys. Enough atomic ordering should occur upon solidification to achieve high magnetic coercivity. However, a magnetically soft crystalline microstructure should be avoided. While spin melting is a suitable method of quenching molten RE-TM to achieve hard magnetic materials, any other equivalent quenching means such as, e.g., spraying the molten metal onto a cooled substrate would fall within the scope of my invention.

I have, e.g., spun melt an alloy of $Nd_{0.5}Fe_{0.5}$ from an orifice 500 microns in diameter at an ejection pressure of 2.5 psi on a room temperature chill surface moving at a relative speed of 2.5 meters per second to directly yield an alloy with a measured coercivity of 8.65 kilo-Oersteds. The spun melt magnetic alloy had a substantially flat X-ray diffraction pattern.

DETAILED DESCRIPTION

My invention will be better understood in view of preferred embodiments thereof described by the following figures, descriptions and examples.

APPARATUS

Figure 1:
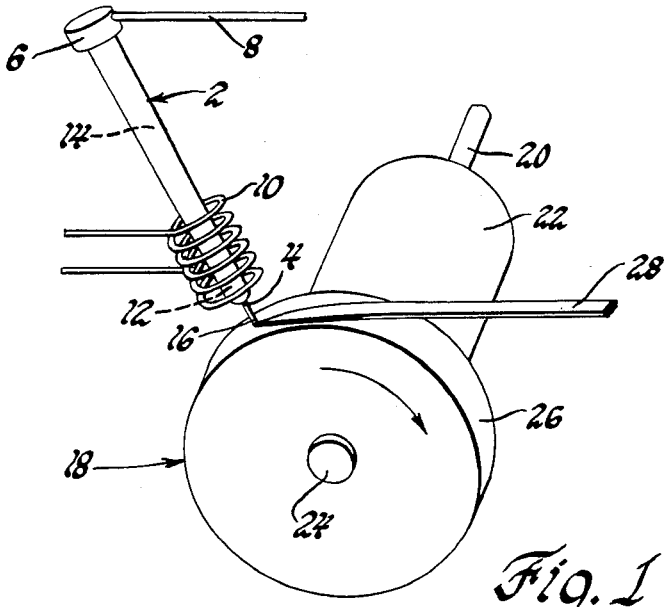
FIG. 1 is a schematic view of a spin melting apparatus suitable for use in the practice of the invention.

FIG. 1 shows a schematic representation of a spin melting apparatus that could be used to practice the method of this invention. A hollow generally cylindrical quartz tube 2 is provided for retaining alloys of rare earth and transition metals for melting. The tube has a small orifice 4 in its bottom through which molten alloy is expressed. Tube 2 is provided with cap 6 which sealably retains inlet tube 8 for a pressurized inert gas such as argon. An induction type heating coil 10 is disposed around the portion of quartz tube 2 containing the metals. When the coil is activated, it heats the material within the quartz tube causing it to melt and form a fluid mass 12 for ejection through orifice 4. Gas is introduced into space 14 above molten alloy 12 to maintain a constant positive pressure so that the molten alloy is expressed at a controlled rate through orifice 4. The expressed stream 16 immediately impinges on rotating disk 18 made of copper metal plated with chromium to form a uniform ribbon 28 of alloy. Disk 18 is retained on shaft 20 and mounted against inner and outer retaining members 22 and 24, respectively. Disk 18 is rotated in a clockwise direction as depicted by a motor not shown. The relative velocity between expressed molten metal 16 and chill surface 26 is controlled by changing the frequency of rotation. The speed of disk 18 will be expressed herein as the number of meters per second which a point on the chill surface of the disk travels at a constant rotational frequency. Means may be provided within disk 18 to chill it. Disk 18 is much more massive than ribbon 28 and acts as an infinitely thick heat sink. The limiting factor for the rate of chill of the molten alloy of stream 4 is the thickness of ribbon 28. If ribbon 28 is too thick, the metal most remote from chill surface 26 will cool more slowly than that adjacent the chill surface. If the rare earth-iron alloy cools to slowly from the melt, it will solidify with a crystalline microstructure that is not permanently magnetic. If it cools too quickly, the ribbon will have relatively low coercivity ($<1$ koe). This invention relates to making hard RE-TM magnets by quenching molten mixtures of the elements at a rate between that which yields amorphous soft magnetic material and nonmagnetic crystalline materials. Herein, the term hard magnet or hard magnetic alloy will generally refer to an Re-Fe alloy with a room temperature coercivity greater than about 1,000 Oersteds that may be formed by quenching from the melt at a suitable rate. Generally, the intrinsic coercivity of these magnetic alloys will increase as the temperature approaches absolute zero.

The operational parameters of a spin melting apparatus may be adjusted to achieve optimum results by the practice of my method. For example, the rare earth and transition metals retained in the melting tube or vessel must be at a temperature above the melting point of the alloy to be in a sufficiently fluid state. The quench time for a spun melt alloy is a function of its temperature at expression from the tube orifice. The amount of pressure introduced into the melting vessel above a molten alloy will affect the rate at which metal is expressed through the orifice. The following description and examples will clearly set out for one skilled in the art methods of practicing and the results obtainable by my invention. In the above described spin melting apparatus, I prefer to use a relatively low ejection pressure, (about 2–3 psig). At such pressures the metal flows out of the orifice in a uniform stream so that when it impinges and is quenched on the cooling disk it forms a relatively uniform ribbon. Another parameter that can be adjusted is the orifice size at the outlet of the melting vessel. The larger the orifice, the faster the metal will flow from it, the slower it will cool on the chill surface and the larger will be the resultant ribbon. I prefer to operate with a round orifice with a diameter from about 250–1200 microns. Other orifice sizes may be suitable, but all other parameters would have to be adjusted accordingly for much smaller or larger orifice sizes. Another critical factor is the rate at which the chill substrate moves relative to the impingement stream of rare earth-iron alloy. The faster the substrate moves, the thinner the ribbon of rare earth transition metal formed and the faster the quench. It is important that the ribbon be thin enough to cool substantially uniformly throughout. The temperature of the chill substrate may also be adjusted by the inclusion of heating or cooling means beneath the chill surface. It may be desirable to conduct a spin melting operation in an inert atmosphere so that the Re-Fe alloys are not oxidized as they are expressed from the melting vessel and quenched.

PREFERRED COMPOSITIONS

The hard magnets of this invention are formed from molten homogeneous mixtures of rare earth elements and transition elements, particularly iron. The rare earth elements are the group falling in Group IIIA of the periodic table and include the metals scandium, yttrium and the elements from atomic number 57 (lanthanum) through 71 (lutetium). The preferred rare earth elements are the lower atomic weight members of the lanthanide series. These are the most abundant and least expensive of the rare earths. In order to achieve the high magnetic coercivities desired, I believe that the outer f-orbital of the rare earth constituents should not be empty, full, or half full. That is, there should not be zero, seven, or fourteen valence electrons in the outer f-orbital. Also suitable would be mischmetals consisting predominantly of these rare earth elements.

Herein, the relative amounts of rare earth and transition metals will be expressed in atomic fractions. In an alloy of $Nd_{0.6}Fe_{0.4}$, e.g., the alloyed mixture would contain proportionately on a weight basis 0.6 moles times the atomic weight of neodymium (144.24 grams/- moles) or 86.544 grams and 0.4 moles times the atomic weight of iron (55.85 grams per mole) or 22.34 g. On a weight percent basis $Nd_{0.6}Fe_{0.4}$ would contain $$\frac{\text{Wt Nd}}{\text{Wt Nd} + \text{Wt Fe}} \times 100 = 79.5\% \text{ Nd and}$$

$$\frac{\text{Wt Fe}}{\text{Wt Nd} + \text{Wt Fe}} \times 100 = 20.5\% \text{ Fe.}$$

An atomic fraction of 0.4 would be equivalent to 40 atomic percent. The compositional range of the RE-TM alloys of this invention is about 20–70 atomic percent transition metal and the balance rare earth metal. Small amounts of other elements may be present so long as they do not materially affect the practice of the invention.

MAGNETISM

Magnetically soft, amorphous, glass-like forms of the subject rare earth-transition metal alloys can be achieved by spin melting followed by a rapid quench. Any atomic ordering that may exist in the alloys is extremely short range and cannot be detected by X-ray diffraction. They have high magnetic field saturations but low room temperature intrinsic coercivity, generally 100–200 Oe.

The key to practicing my invention is to quench a molten rare earth-transition metal alloy, particularly rare earth-iron alloy, at a rate slower than the cooling rate needed to form amorphous, glass-like solids with soft magnetic properties but fast enough to avoid the formation of a crystalline, soft magnetic microstructure. High magnetic coercivity (generally greater than 1,000 Oe) characterizes quenched RE-TM compositions formed in accordance with my method. These hard magnetic properties distinguish my alloys from any like composition previously formed by melt-spinning, simply alloying, or high rate sputtering followed by low temperature annealing. X-ray diffraction patterns of some of the Nd-Fe and Pr-Fe alloys to contain weak Bragg reflections corresponding to crystalline rare earths (Nd, Pr) and the $RE_2Fe_{17}$ intermetallic phases. Owing to the low magnetic ordering temperatures of these phases (less than 330° K.), however, it is highly unlikely that they could be the magnetically hard component in these melt spun alloys. The coercive force is believed due to an underlying amorphous or very finely crystalline alloy. The preferred $Sm_{0.4}Fe_{0.6}$ and $Tb_{0.4}Fe_{0.6}$ alloys also contain weak Bragg reflections which could be indexed to the $REFe_2$ intermetallic phases. These phases do have relatively high magnetic ordering temperatures (approximately 700° K.) and could account for the coercivity in these alloys. Magnets made by my invention not only have excellent magnetic characteristics, but are also easy and economical to produce. The following examples will better illustrate the practice of my invention.

EXAMPLE I

Figure 2:
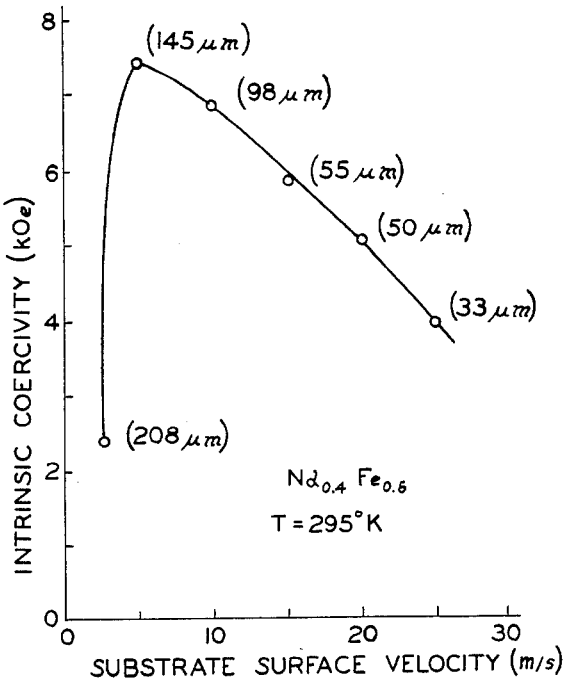
FIG. 2 is a plot of substrate surface velocity versus intrinsic coercivity for $Nd_{0.4}Fe_{0.6}$ at 295° K. The parenthetical numbers adjacent the data points are measured ribbon thicknesses.

A mixture of 63.25 weight percent neodymium metal and 36.75 weight percent iron was melted to form a homogeneous $Nd_{0.4}Fe_{0.6}$ alloy. A sample of the alloy was dispersed in the tube of a melt spinning apparatus like that shown in FIG. 1. The alloy was melted and ejected through a circular orifice 500 microns in diameter with an argon pressure of 17 kPa (2.5 psi) onto a chill disk initially at room temperature. The velocity of the chill disk was varied at 2.5, 5, 15, 20 and 25 meters per second. The intrinsic coercivities of the resulting alloys were measured at a temperature of 295° K. The alloy ribbons were pulverized to powder by a roller on a hard surface and retained in the sample tube of a magnetometer. FIG. 2 plots the measured intrinsic coercivity in kiloOersteds as a function of the substrate surface velocity for the chill member. The parenthetical numbers adjacent the data points correspond to measured ribbon thicknesses in microns. It is clear that a substrate velocity of 2.5 meters per second does not achieve the desired optimum coercivity. We believe that the ribbon layed down at this substrate surface velocity was too thick (208 microns). It cooled slowly enough to allow the growth of nonmagnetic crystal structures. The optimum quench rate appeared to be achieved at a disk surface velocity of 5 meters per second. At higher disk speeds (faster quench and thinner ribbon) the room temperature intrinsic coercivity decreased gradually indicating the formation of amorphous soft magnetic structures in the alloy.

EXAMPLE II

Figure 3:
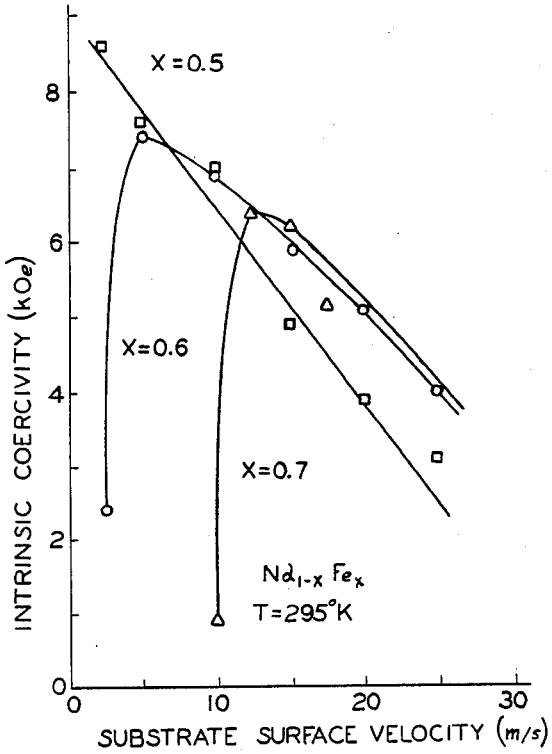
FIG. 3 is a plot of substrate surface velocity versus intrinsic coercivity for three different spun melt neodymium-iron alloys.

FIG. 3 shows a plot of measured intrinsic magnetic coercivity at 295° K. as a function of chill disk surface velocity for three different neodymium iron alloys. The alloys were composed of $Nd_{1-x}Fe_x$ where x is 0.5, 0.6 and 0.7. The maximum achievable coercivity seems to be a function of both the substrate surface velocity and the composition of the rare earth transition metal alloy. The greatest coercivity was achieved for $Nd_{0.5}Fe_{0.5}$ and a chill disk surface speed of about 2.5 meters per second. The other two neodymium iron alloys containing a greater proportion of iron showed lower maximum coercivities achieved at relatively higher substrate surface velocities. However, all of the materials had extremely good maximum room temperature coercivities (greater than 6 kiloOersteds).

EXAMPLE III

Figure 4:
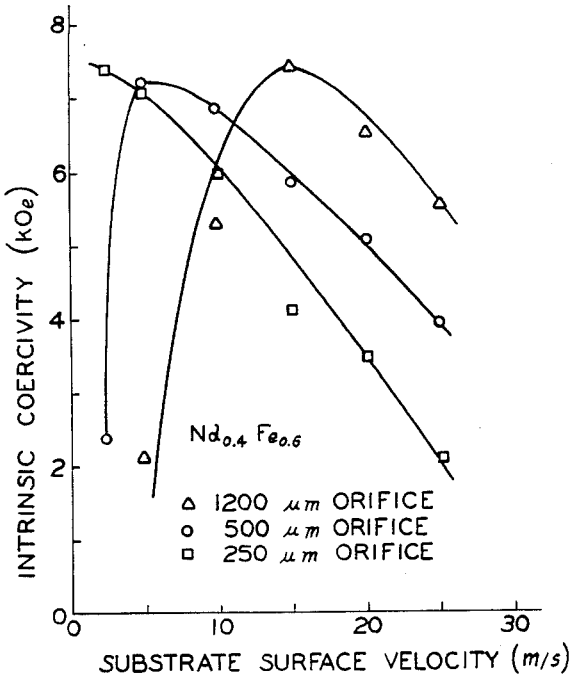
FIG. 4 is a plot of chill substrate surface velocity versus intrinsic magnetic coercivity for spun melt $Nd_{0.4}Fe_{0.6}$ at ejection orifice diameters of 1200, 500 and 250 microns.

FIG. 4 shows the effect of varying the size of the ejection orifice of an apparatus like that shown in FIG. 1 for $Nd_{0.4}Fe_{0.6}$. The ejection gas pressure was maintained at about 2.5 psig and the chill disk was initially at room temperature. The figure shows that substrate surface velocity must increase as the orifice size increases. For the 250 micron orifice, the maximum measured coercivity was achieved at a substrate speed of about 2.5 meters per second. For the 500 micron orifice, the optimum measured coercivity was at a chill surface speed of 5 meters per second. For the largest orifice, 1200 microns in diameter, the optimum substrate surface speed was higher, 15 meters per second. Again, the process is limited by the thickness of the ribbon formed on the chill surface. That is, that portion of the metal most remote from the chill surface itself must cool by heat transfer through the balance the spun melt material at a rate fast enough to achieve the desired ordering of atoms in the alloy. Homogeneous cooling is desired so that the magnetic properties of the ribbon are uniform throughout. The faster the chill surface travels, the thinner the ribbon of RE-TM produced.

EXAMPLE IV

Figure 5:
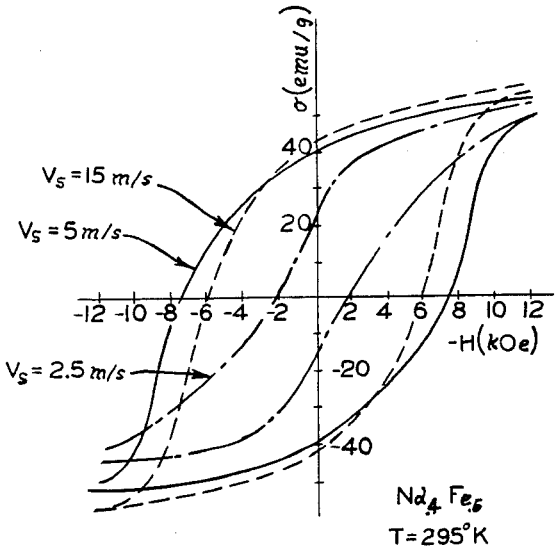
FIG. 5 is a hysteresis curve for $Nd_{0.4}Fe_{0.6}$ taken at 295° C. for four different chill substrate speeds.

FIG. 5 shows hysteresis curves for $Nd_{0.4}Fe_{0.6}$ ejected from a 500 micron orifice at a gas pressure of 2.5 psi onto a chill member moving at rates of 2.5, 5, and 15 meters per second, respectively. Those alloys ejected onto the substrate moving at a speed of 2.5 meters per second had relatively low room temperature coercivity. The narrow hysteresis curve suggests that this alloy is a relatively soft magnetic material. Alternatively, the relatively wide hysteresis curves for chill substrate velocities of 5 and 15 meters per second are indicative of materials with high intrinsic magnetic coercivities at room temperatures. They are good hard magnetic materials.

EXAMPLE V

Figure 6:
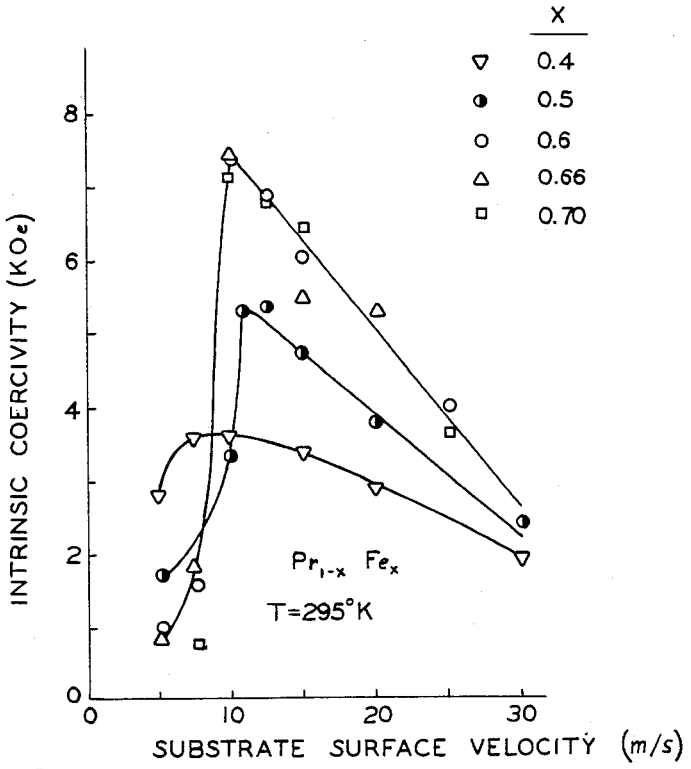
FIG. 6 is a plot of substrate surface velocity versus intrinsic coercivity for 5 different alloys of spun melt praseodymium-iron alloys.

FIG. 6 is a plot of chill disk velocity versus measured intrinsic coercivity in kiloOersteds for alloys of $Pr_{1-x}Fe_x$ where x is 0.4, 0.5, 0.6, 0.66 and 0.7. The alloys were ejected at a pressure of about 2.5 psig through a 500 micron orifice. The $Pr_{0.34}Fe_{0.66}$ and $Pr_{0.3}Fe_{0.7}$ quenched on a disk moving at about ten meters per second had measured intrinsic coercivities at 22° C. of greater than 7 kiloOersteds. The $Pr_{0.6}Fe_{0.4}$ alloy had a maximum measured coercivity of about 3.8 kiloOersteds at a quench disk surface velocity of about five meters per second.

I have also spun melt samples $Tb_{0.4}Fe_{0.6}$ and $Sm_{0.4}Fe_{0.6}$. The maximum coercivity measured for the terbium alloy was about three kiloOersteds. The samarium alloy developed a room temperature coercivity of at least 15 kiloOersteds, the highest coercivity measurable by the available magnetometer. Spun melt samples of $Y_{0.6}Fe_{0.4}$ did not develop high intrinsic coercivities. The measured coercivities of the yttrium samples were in the 100–200 Oersted range.

Thus I have discovered a reliable and inexpensive method of making alloys of rare earth elements and iron into hard magnetic materials. Heretofore, no one has been able to make such high coercivity magnets from low molecular weight rare earth elements, mischmetals, or even samarium and iron. Accordingly, while my invention has been described in terms of specific embodiments thereof, other forms may be readily adapted by one skilled in the art. Accordingly, my invention is to be limited only by the following claims.

The embodiments of the invention in which an exclusive property or privilege is claimed are defined as follows:

1. A method of making an alloy with permanent magnetic properties at room temperature comprising the steps of forming a mixture of iron and one or more rare earth elements;
   heating said mixture to form a homogeneous molten alloy; and
   quenching said molten alloy at a rate such that it solidifies substantially instantaneously to form an alloy having an inherent room temperature magnetic coercivity of at least about 5,000 Oersteds as quenched.

2. A method of making a permanent magnet comprising the steps of:
   melting an alloy of 20 to 70 atomic percent iron and the balance one or more rare earth elements taken from the group consisting of praseodymium, neodymium, and samarium;
   quenching said molten alloy at a rate such that it solidifies substantially instantaneously to form an alloy with a substantially amorphous to very finely crystalline microstructure as measured by X-ray diffraction having a room temperature intrinsic magnetic coercivity of at least about 1,000 Oersteds; and
   comminuting and compacting said alloy into a magnet shape and magnetizing it in an applied magnetic field.

3. A method of making an alloy with permanent magnetic properties comprising the steps of:
   alloying a mixture consisting essentially of 20 to 70 atomic percent iron and the balance of one or more rare earth elements taken from the group consisting of praseodymium, neodymium, and samarium;
   melting said alloy to form a fluid mass;
   withdrawing a small amount of said alloy from said fluid mass; and
   instantaneously quenching said small fluid amount such that the as quenched alloy has an inherent intrinsic magnetic coercivity of at least 1,000 Oersteds at room temperature.

4. A method of making a magnetically hard alloy directly from a molten mixture or iron and rare earth elements comprising:
   melting a mixture consisting essentially of 20 to 70 atomic percent iron and the balance one or more rare earth elements taken from the group consisting of neodymium, praseodymium, and mischmetals thereof;
   expressing said molten mixture from an orifice; and
   immmediately impinging said expressed mixture onto a chill surface moving at a rate with respect to the expressed metal such that it rapidly solidifies to form an alloy ribbon with a thickness less than about 200 microns having a magnetic coercivity at room temperature of at least about 1,000 Oersteds.

5. A method of making an iron-rare earth element alloy having a magnetic coercivity of at least 1,000 Oersteds at room temperature comprising melting an alloy of 20 to 70 atomic percent iron and the balance one or more rare earth elements taken from the group consisting of praseodymium, neodymium, samarium, and mischmetals thereof; and ejecting said alloy through an orifice sized such that when the ejected alloy is impinged onto a chill surface traveling at a substantially constant velocity relative thereto, a ribbon having a thickness less than about 200 microns and a substantially amorphous to very finely crystalline microstructure as determinable by ordinary X-ray diffraction is formed.

6. A method of making an iron-rare earth element permanent magnet alloy having a Curie temperature above 295° K. and a coercivity greater than about 1,000 Oersteds at room temperature comprising melting an alloy consisting essentially of 20 to 70 atomic percent iron and the balance one or more rare earth elements taken from the group consisting of praseodymium, neodymium and samarium; expressing said alloy through an orifice; and impinging the expressed metal onto a chill surface traveling at a velocity relative thereto such that an alloy ribbon having a thickness less than about 200 microns is formed.

7. A friable ribbon of rare earth-iron alloy having been formed by melt-spinning a homogeneous mixture of iron and neodymium, said ribbon having an intrinsic magnetic coercivity at room temperature of at least 1,000 Oersteds as formed.

8. A method of making an alloy with permanent magnetic properties at room and elevated temperatures comprising the steps of:
   mixing iron and one or more rare earth elements taken from the group consisting of praseodymium, neodymium and samarium;

melting said mixture; and quenching said molten mixture at a rate such that it solidifies to form an alloy having a substantially flat X-ray diffraction pattern and an intrinsic magnetic coercivity at room temperature of at least about 1,000 Oersteds.

9. A method of making an alloy with permanent magnetic properties at room temperature comprising the steps of:

forming a mixture of iron and at least one rare earth element taken from the group consisting of praseodymium, neodymium, samarium and mischmetals thereof;

heating said mixture in a crucible to form a homogeneous molten alloy;

pressurizing said crucible to eject said mixture through an orifice in its bottom about 250–1200 micronmeters in diameter; and impinging said ejected mixture onto the perimeter of a chill wheel rotating at a rate such that an alloy ribbon less than 200 microns thick with an intrinsic coercivity of at least 5,000 Oersteds at room temperature is formed.

10. A method of making an alloy which may be directly manufactured into a permanent magnet as it is quenched from the melt comprising:

melting an alloy of iron and one or more rare earth elements taken from the group consisting of neodymium, praseodymium, samarium and mischmetals thereof;

expressing said molten alloy from an orifice; and immediately impinging said expressed alloy onto a chill surface moving at a rate with respect to the expressed metal such that it solidifies substantially instantaneously to form a brittle ribbon with a thickness less than about 200 microns and a magnetic coercivity at room temperature of at least about 1,000 Oersteds.

11. A method of making an iron-rare earth element alloy having an inherent magnetic coercivity of at least 1,000 Oersteds at room temperature comprising:

alloying a mixture of iron and one or more rare earth elements taken from the group consisting of praseodymium, neodymium, samarium and mischmetals thereof;

melting said iron-rare earth alloy in a crucible having an outlet orifice through which said alloy may be expressed at a controlled rate;

expressing said alloy from said orifice and impinging the expressed molten stream onto the perimeter of a rotating chill surface traveling at a relative velocity with respect to the stream such that an alloy ribbon having a thickness less than about 200 microns and a substantially amorphous to very finely crystalline microstructure as determinable by X-ray diffraction is formed.

12. A permanent magnet having an inherent intrinsic magnetic coercivity of at least 5,000 Oersteds at room temperature comprising a rapidly quenched alloy of iron and one or more rare earth elements taken from the group consisting of neodymium, samarium and praseodymium.

13. A permanent magnet alloy having an inherent intrinsic magnetic coercivity of at least 5000 Oersteds at room temperature comprising iron and one or more rare earth elements taken from the group consisting of neodymium and praseodymium.

14. A permanent magnet having an inherent intrinsic magnetic coercivity of at least 5000 Oersteds at room temperature which comprises one or more light rare earth elements taken from the group consisting of neodymium and praseodymium and at least 50 atomic percent iron.

15. A permanent magnet having an inherent intrinsic magnetic coercivity of at least 5000 Oersteds at room temperature and a magnetic ordering temperature above about 295° K. which comprises one or more rare earth elements taken from the group consisting of neodymium and praseodymium, and at least about 50 atomic percent iron.

16. A permanent magnet alloy having an inherent intrinsic magnetic coercivity of at least 5000 Oersteds at room temperature and a magnetic ordering temperature above about 295° K. comprising one or more rare earth element constituents taken from the group consisting of neodymium, praseodymium or mischmetals thereof and iron or iron mixed with a small amount of cobalt where the iron comprises at least 50 atomic percent of the alloy.

17. A permanent magnet containing a magnetic phase based on one or more rare earth elements and iron, which phase has an intrinsic magnetic coercivity of at least 5,000 Oersteds at room temperature and a magnetic ordering temperature above about 295° K., the rare earth constituent consisting predominantly of neodymium and/or praseodymium.

18. A permanent magnet based on neodymium and iron, which phase has an intrinsic magnetic coercivity of at least 5,000 Oersteds at room temperature and a magnetic ordering temperature above about 295° K.

19. A magnetically hard alloy consisting essentially of at least 20 atomic percent iron and the balance one or more rare earth elements taken from the group consisting of praseodymium, neodymium and samarium, said alloy having been formed by instantaneously quenching a homogeneous molten mixture of the rare earth and iron to create a magnetic microstructure with an instrinsic magnetic coercivity of at least 1,000 Oersteds at room temperature.

20. A substantially amorphous to very finely crystalline alloy that therefor has a magnetic coercivity of at least about 1,000 Oersteds at room temperature comprising 20 to 70 atomic percent iron and the balance one or more rare earth elements taken from the group consisting of praseodymium and neodymium or mischmetals thereof.

21. A friable metal ribbon having a coercivity of at least about 1,000 Oersteds at room temperature that can be comminuted, pressed and magnetized as quenched from the melt to make permanent magnets comprising 20 to 70 atomic percent iron, and one or more rare earth elements taken from the group consisting of praseodymium, neodymium and mischmetals thereof.

* * * * *